US005697823A

United States Patent [19]

Santoku et al.

[11] Patent Number: 5,697,823

[45] Date of Patent: Dec. 16, 1997

[54] ELECTRON GUN OF CRT AND MANUFACTURING METHOD THEREFOR

[75] Inventors: Masataka Santoku, Kanagawa; Jyoji Karasawa; Daichi Imabayashi, both of Tokyo, all of Japan

[73] Assignee: Sony Corporation, Tokyo, Japan

[21] Appl. No.: 517,440

[22] Filed: Aug. 21, 1995

Related U.S. Application Data

[62] Division of Ser. No. 262,698, Jun. 20, 1994, Pat. No. 5,514,930.

[30] Foreign Application Priority Data

| | | | |
|---|---|---|---|
| Jun. 21, 1993 | [JP] | Japan | P05-173700 |
| Jun. 25, 1993 | [JP] | Japan | P05-177529 |
| Jun. 25, 1993 | [JP] | Japan | P05-177530 |

[51] Int. Cl.[6] ..... H01J 9/18; H01J 9/42

[52] U.S. Cl. ..... 445/3; 445/34; 445/67

[58] Field of Search ..... 445/34, 67, 3

[56] References Cited

U.S. PATENT DOCUMENTS

| | | | |
|---|---|---|---|
| 4,414,485 | 11/1983 | Marschka | 445/34 |
| 4,846,748 | 7/1989 | Cote | 445/67 |

FOREIGN PATENT DOCUMENTS

| | | | |
|---|---|---|---|
| 5-36360 | 3/1931 | Japan . | |
| 5-166457 | 3/1991 | Japan . | |
| 5-325816 | 5/1992 | Japan . | |
| 5-166458 | 7/1993 | Japan | 445/34 |

*Primary Examiner*—P. Austin Bradley
*Assistant Examiner*—Jeffrey T. Knapp
*Attorney, Agent, or Firm*—Hill, Steadman & Simpson

[57] ABSTRACT

An electron gun cathode structure includes a support member made of an insulating material, a first grid fixed to the support member, and a cathode disposed on the side of the support member opposite to the first grid. A thermal expansion $\Delta L_S/L_S$ of the insulating material constituting the support member due to heat from the cathode is larger than a thermal expansion $\Delta L_G/L_G$ of a material constituting the first grid due to heat from the cathode. A manufacturing method of an electron gun cathode structure includes preparing a member including a first face and a second face having a step therebetween, a height of the step being equal to a predetermined distance $d_{12}$, placing a first grid on the first face, placing a spacer on the second face, placing an insulating support member on the first grid and the spacer, and grinding a top surface of the spacer opposite to its surface that is fixed to the support member so that an actual distance $d_{12}$ becomes a desired value. Further, a distance d between the top surface of the spacer and a cathode is measured with a non-contact type distance measuring instrument, and a position of the cathode with respect to the first grid is so set that a difference $d-d_{12}$ becomes a desired value.

3 Claims, 8 Drawing Sheets

ELECTRON GUN OF CRT AND MANUFACTURING METHOD THEREFOR

This is a division of application Ser. No. 08/262,698, filed Jun. 20, 1994, now U.S. Pat. No. 5,514,930. Transfer the drawings from the prior application to this application and abandon said prior application as of the filing date accorded this application. A duplicate copy of this sheet is enclosed for filing in the prior application file.

BACKGROUND OF THE INVENTION

1. Field of the Invention

The present invention relates to an electron gun of a cathode ray tube (hereinafter abbreviated as CRT) and a manufacturing method therefor.

2. Description of the Prior Art

The cathode cutoff voltage $E_{KCO}$, which is one of the characteristics of an electron gun cathode structure, is the most important one among various characteristics of a CRT. It is very important to suppress a variation of the cathode cutoff voltage $E_{KCO}$ to obtain good characteristics of a CRT. For example, the cathode cutoff voltage $E_{KCO}$ depends on a distance $d_{01}$ between a cathode and a first grid, a distance $d_{12}$ between the first grid and a second grid, thicknesses $t_{G1}$ and $t_{G2}$ of the first and second grids, a diameter $\Phi_1$ of an emission aperture of the first grid, a diameter $\Phi_1$ of an emission aperture of the second gird, and a positional relationship between these emission apertures such that $$E_{KCO}=k\Phi_1^a\Phi_2^b/(d_{01}^e d_{12}^d t_{G1}^e t_{G2}^f)$$

where k, a, b, c, d, e and f are constants.

An electron gun of a CRT includes a cathode for emitting electrons and a plurality of electrodes for forming an electron beam from the emitted electrons and focusing the electron beam onto a phosphor screen while accelerating it to a high speed. For example, the present inventors' Japanese Patent Application No. Hei. 4-155765 describes an example of an electron gun.

The present inventors have proposed an electron gun in which variations of the distance $d_{01}$ between a cathode and a first grid and the distances between the first grid and a second grid are reduced to thereby suppress a variation of the cathode cutoff voltage $E_{KCO}$ (Japanese Patent Application Unexamined Publication No. Hei. 5-36360). In this electron gun, a plurality of grids other than the first grid are supported by a pair of glass support bars so as to be arranged in order at predetermined intervals. Thus electron gun is characterized in that the first grid is fixed to an insulating support member, and is attached to the second grid through a spacer which defines the distance between the first and second grids. For example, the first grid is fixed to the support member by silver brazing.

FIG. 1 is a schematic sectional view showing an arrangement of a first grid $G_l$, an insulating support member 10, a spacer 12 and a cathode of the electron gun disclosed in the above-mentioned publication Hei. 5-36360. The cathode consists of a generally cylindrical sleeve 20, a cap 22 covering a tip portion of the sleeve 20, and an oxide material 24 as an emission source provided on top of the cap 22. A heater 26 is disposed in the generally cylindrical sleeve, whose bottom portion is a little larger in diameter than its top portion. A sleeve support member 28, which is cylindrical, is attached to the face of the support member 10 that is opposite to the face to which the spacer 12 is attached. The sleeve 20 is fixed to the sleeve support member 28. A second grid $G_2$ is attached to the top face of the spacer 12. A though-hole 10a is formed in the support member 10 so as to correspond to an emission aperture $G_e$ of the first grid $G_1$.

The distance between the top face of the spacer 12 and the top face of the first grid $G_1$ corresponds to the distance $d_{12}$. The distance between the bottom face of the first grid $G_1$ and the cathode (specifically, the oxide material 24) corresponds to the distance $d_{01}$.

In an ordinary CRT, it takes about 30 minutes for an operation of the CRT to reach the steady state from the start, i.e., turning on of the heater 26 of the cathode structure. During this period, heat radiation and conduction from the heater 26 makes the sleeve 20, support member 10 and first grid $G_1$ thermally expand to cause deformation of the first grid $G_1$. This deformation usually originates from the fact that a thermal expansion $\Delta L_S/L_S$ of a material constituting the support member 10 is smaller than a thermal expansion $\Delta L_G/L_G$ of a material constituting the first grid $G_1$ due to the heat coming from the cathode.

The thermal expansion $\Delta L_S/L_S$ can be expressed as $\alpha_S\Delta t_S$ where $\alpha_S$ is a linear expansion coefficient of the material constituting the support member 10 and $\Delta t_S$ is a difference between the temperature of the support member 10 being subjected to the heat from the cathode and the room temperature. Similarly, the thermal expansion $\Delta L_G/L_G$ can be expressed by $\alpha_G\Delta t_G$ where $\alpha_G$ is a linear expansion coefficient of the material constituting the first grid $G_1$ and $\Delta t_G$ is a difference between the first grid $G_1$ being subjected to the heat from the cathode and the room temperature. The above notation is also employed in the following description. In some cases, the thermal expansion $\Delta L_S/L_S$ of the material constituting the support member 10 and the thermal expansion $\Delta L_G/L_G$ of the material constituting the first grid $G_1$ are simply expressed as a thermal expansion of the support member 10 and a thermal expansion of the first grid $G_1$, respectively.

When the support member 10 and the first grid $G_1$ thermally expand due to the heat radiation and conduction from the cathode, the thermal expansion of the first grid $G_1$ is larger than that of the support member 10. Therefore, as schematically shown in FIG. 2, the first grid $G_1$ is deformed so as to become convex upward, so that the distance $d_{01}$ between the cathode and the first grid $G_1$ and the distance $d_{12}$ between the first grid $G_1$ and the second grid $G_2$ are varied. Further, a relative positional relationship between the cathode and the emission apertures of the first and second grids is also varied. As a result, there occur a change of the cathode cutoff voltage $E_{KCO}$, a large movement of a beam spot and a temporal variation of the luminance of a CRT screen.

To avoid positional deviations of the emission apertures of the first grid $G_1$ and the second grid $G_2$, an electron gun is usually assembled by using the emission apertures themselves as a guide or by using proper guide holes. However, during heat treatments after the electron gun assembling, such as those in a CRT baking step and a gun heating step, the first grid $G_1$ is deformed due to the difference in thermal expansion between the support member 10 and the first grid $G_1$. As a result, the distance $d_1$ between the cathode and the first grid $G_1$ and the distance $d_{12}$ between the first grid $G_1$ and the second grid $G_2$ are varied. Further, a relative positional relationship between the cathode and the emission apertures of the first and second grids is also varied. The heat treatments also vary the cathode cutoff voltage $E_{KCO}$ in the above manner.

In order to keep the distance $d_{12}$ constant, another conventional technique employs a structure in which a spacer 111 made of an insulating material is inserted between a first grid 112 and a second grid 113 (see FIG. 3A). An electron gun cathode structure shown in FIG. 3A is produced such that both surfaces of the spacer 111 are metalized in advance, and the opposing surfaces of the first grid 112 and the spacer 111 and the opposing surfaces of the spacer 111 and the second grid 113 are brazed to each other in a state that a shaft 14*a* of a brazing jig 14 is inserted into the first grid 112, spacer 111 and second grid 113.

However, in the electron gun cathode structure shown in FIG. 3A, the distance $d_{12}$ is varied by variations of the thickness of the brazing material and the thicknesses of the metal layers formed by the metalizing treatment, variations in the flatness of the first grid 112 and the second grid 113, and other factors.

To solve this problem, an electron gun cathode structure shown in FIG. 3B has been proposed in which a metal spacer 15 and a first grid 16 are fixed to the same flat surface 17*a* of a support member 17 made of an insulating material, and a second grid (not shown) is fixed to a surface 15*a* of the spacer 15 opposite to the surface that is fixed to the support member 17. In this electron gun cathode structure, a step between the surface 16*a* of the first grid 16 and the surface 15*a* of the spacer 15 opposite to the surface that is fixed to the support member 17 corresponds to the distance $d_{12}$.

The electron gun cathode structure of FIG. 3B is manufactured as follows. First, the flat surface 17*a* of the support member 17 is metalized. After shafts 18*a* of a brazing jig 18 are inserted into the support member 17, the first grid 16 and the spacer 15 are placed on the flat surface 17*a*. Then, the opposing surfaces of the first grid 16 and the support member 17 and the opposing surfaces of the spacer 15 and the support member 17 are brazed to each other while the first grid 16 and the spacer 15 are pressed by pressing portions 18*b*.

The distance $d_{12}$ appears to be set more correctly in the electron gun cathode structure of FIG. 3B than in that of FIG. 3A. However, in the manufacturing method of the electron gun cathode structure shown in FIG. 3B, no proper measures are taken to suppress variations in the flatness of the support member 17, first grid 16 and spacer 15, variations of the thickness of the brazing material and the thickness of the metal layer formed by the metalizing treatment, variations of the thicknesses of the spacer 15 and the first grid 16, and other factors. Therefore, the distance $d_{12}$ is not necessarily set correctly, failing to suppress the variation of the cathode cutoff voltage $E_{KCO}$ to a small value.

Considering the above, the present inventors have proposed a novel manufacturing method of an electron gun cathode structure (Japanese Patent Application Unexamined Publication No. Hei. 5-166457), which will be described later in detail. This manufacturing method allows the distance to be set correctly to a certain extent.

However, to improve the characteristics of an electron gun cathode structure, it is now desired to set the distance $d_{12}$ more correctly without a variation.

Conventionally, the distance $d_{01}$ between the cathode and the first grid $G_1$ is adjusted in the following manner using an air-micro device as a non-contact type distance measuring instrument. As shown in FIG. 4A, a nozzle portion 54 is inserted through the emission aperture $G_e$ of the first grid $G_1$ with a reference surface 52 of an air-micro device 50 contacted with the top surface of the first grid $G_1$. A pressurized gas such as a nitrogen gas or an air is jetted from the nozzle portion 54 of the air-micro device 50 to the oxide material 24 of the cathode. Since there exists a certain relationship between back pressure of the pressurized gas and the distance between the nozzle portion 54 and the oxide material 24, the distance between the reference surface 52 and the cathode can be obtained by measuring the back pressure with a gauge 56.

To improve the characteristics of CRTs, the diameters of the emission apertures of the respective grids now tend to decrease. Therefore, to maintain the cathode cutoff voltage $E_{KCO}$ at the same value, it is necessary to reduce the thickness of the grids.

However, for example, where the thickness of the first grid $G_1$ is reduced, the first grid $G_1$ is likely deformed when the reference surface 52 of the air-micro device 50 is contacted with the top surface of the first grid $G_1$ (see FIG. 4B). This will cause a problem that the distance $d_{01}$ between the first grid $G_1$ and the cathode cannot be measured precisely. As a result, there occurs a variation of the distance $d_{01}$, which means a variation of $E_{KCO}$, after assembling of an electron gun cathode structure.

SUMMARY OF THE INVENTION

An object of the present invention is to provide an improved electron gun of a CRT and a manufacturing method therefor.

Another object of the invention is to provide an electron gun cathode structure which can suppress a variation of the cathode cutoff voltage $E_{KCO}$ due to deformation of a first grid during heat treatments of a CRT manufacturing process and during a period from the start of an operation of a CRT to a time point when it reaches a steady state.

Another object of the invention is to provide a manufacturing method of an electron gun cathode structure which method can set the distance $d_{12}$ between first and second grids more correctly without a variation.

A further object of the invention is to provide a manufacturing method of an electron gun cathode structure which method can correctly set the distance $d_{01}$ between a first grid and a cathode and suppress a variation of the cathode cutoff voltage $E_{KCO}$.

According to the invention, an electron gun of a cathode ray tube comprises a support member made of an insulating material; a first grid fixed to the support member; and a cathode disposed on the side of the support member opposite to the first grid, wherein a thermal expansion $\Delta L_S/L_S$ of the insulating material constituting the support member due to heat from the cathode is larger than a thermal expansion $\Delta L_G/L_G$ of a material constituting the first grid due to heat from the cathode.

Further, according to the invention, a method of manufacturing an electron gun of a cathode ray tube in which electron gun a first grid and a spacer for defining a distance between the first grid and a second grid are fixed to the same surface of a support member made of an insulating material, comprises the steps of setting a member including a first face and a second face having a step therebetween, a height of the step being equal to said distance; placing the first grid on the first face; placing the spacer on the second face; placing the support member on the first grid and the spacer so that a first grid and the spacer, a thermal expansion of the insulating material constituting the support member due to heat from a cathode being larger than a thermal expansion of a material constituting the first grid due to heat from the cathode; fixing the first grid and the spacer to the surface of the support member while pressing the support member toward the member; grinding a top surface of the spacer opposite to a surface that is fixed to the support member so that a distance between the first grid and the second grid becomes a desired value; and fixing the second grid to the spacer.

The above manufacturing method may further comprise the steps of disposing the cathode on the other side of the support member; measuring a distance $d_{12}$ between the top surface of the spacer and a top surface of the first grid; and measuring, with a non-contact type distance measuring instrument, a distance d between the top surface of the spacer and the cathode in a state that a reference surface of the non-contact type distance measuring instrument is in contact with the top surface of the spacer, and setting a position of the cathode with respect to the first grid so that a difference $d-d_{12}$ becomes a desired value.

DESCRIPTION OF THE PREFERRED EMBODIMENTS

The present invention will be described below by way of embodiments.

Figure 1:
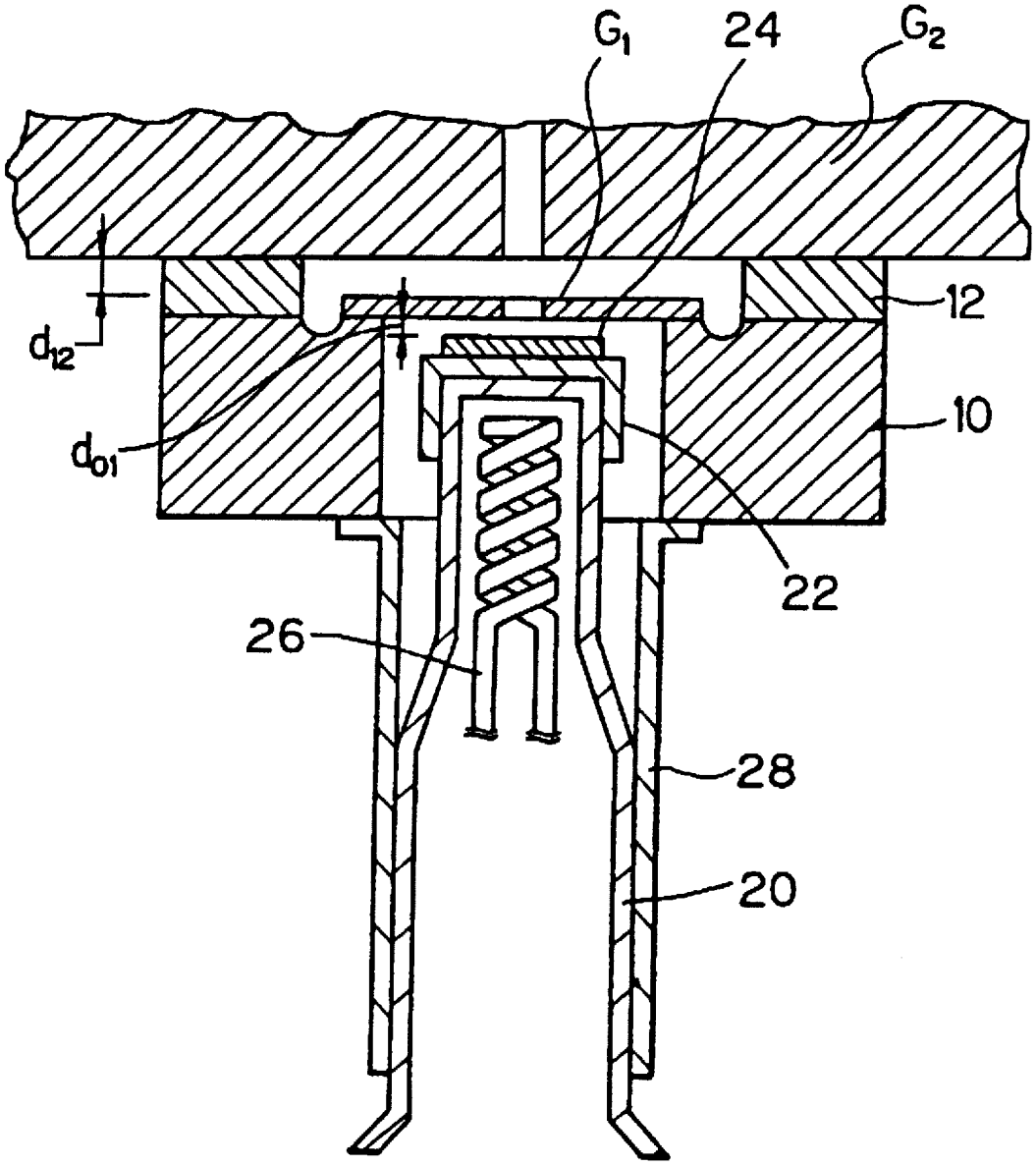
Fig.1 Prior art
FIG. 1 is a sectional view of a conventional electron gun cathode structure.
Figure 2:
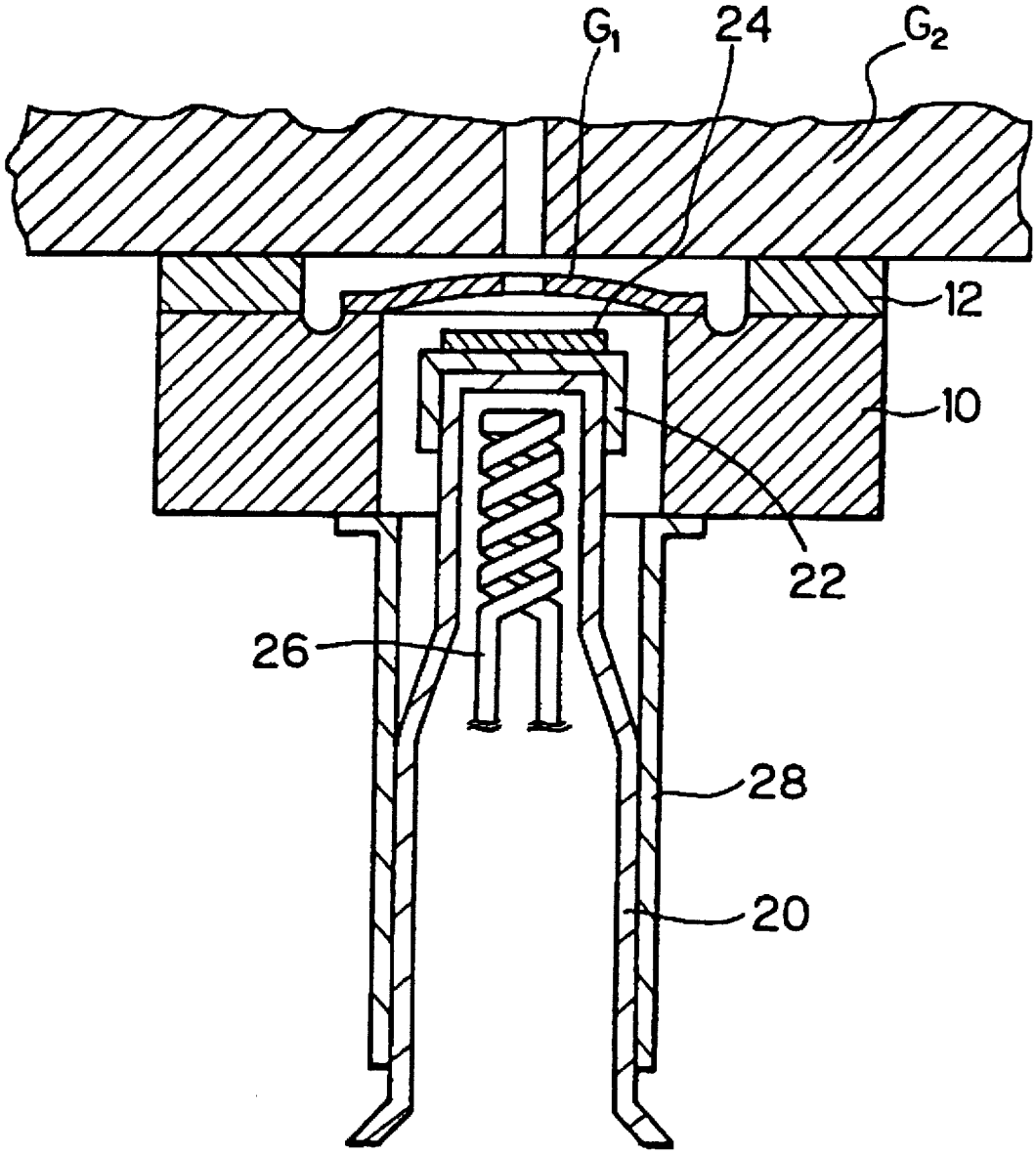
Fig.2 Prior art
FIG. 2 is a sectional view illustrating a problem of the conventional electron gun cathode structure.
Figure 3A:
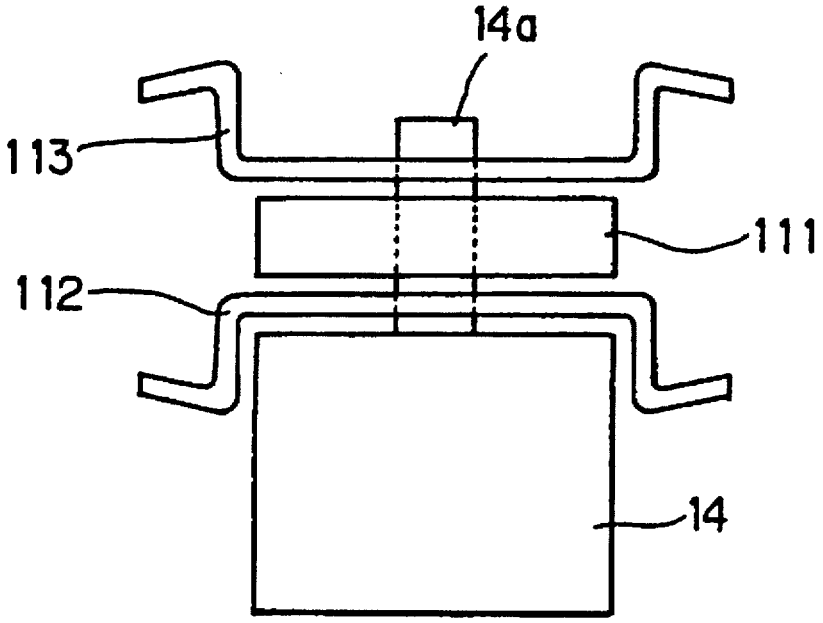
Fig.3A prior art
FIGS. 3A and 3B are side views showing conventional manufacturing methods of electron gun cathode structures.
Figure 3B:
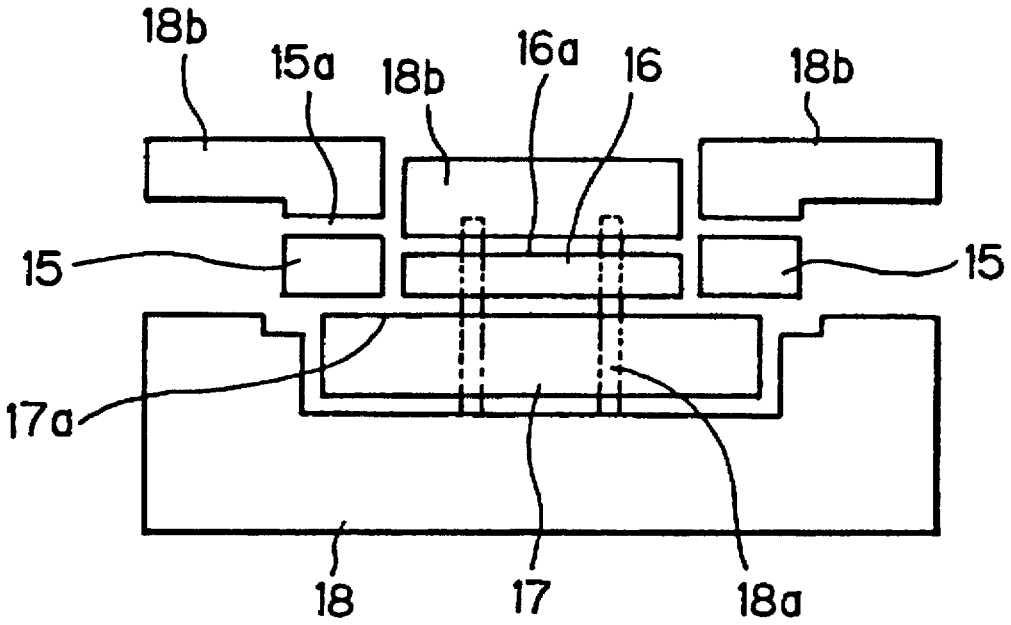
Fig.3B prior art
Figure 4A:
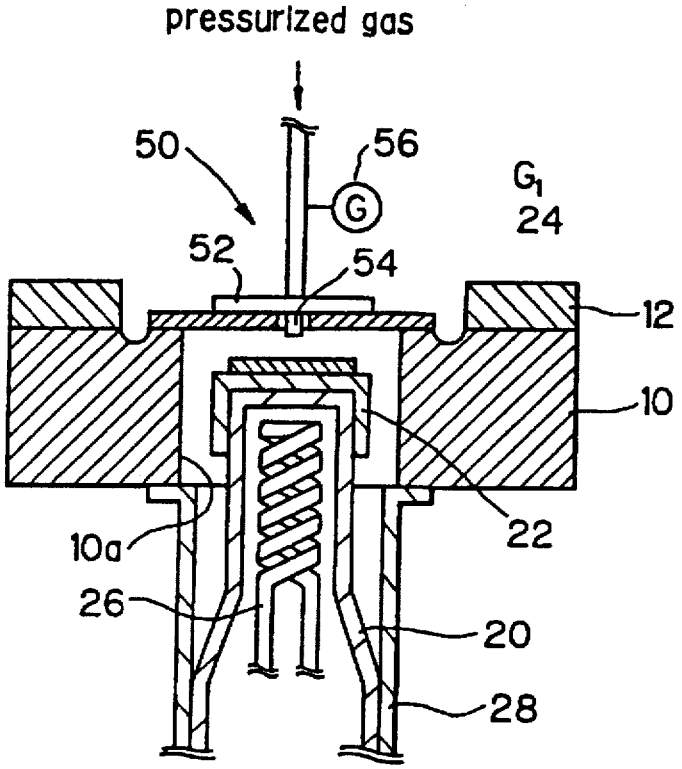
FIGS. 4A and 4B show a conventional method of measuring the distance $d_{01}$, of an electron gun cathode structure, and a problem of that method.
Figure 4B:
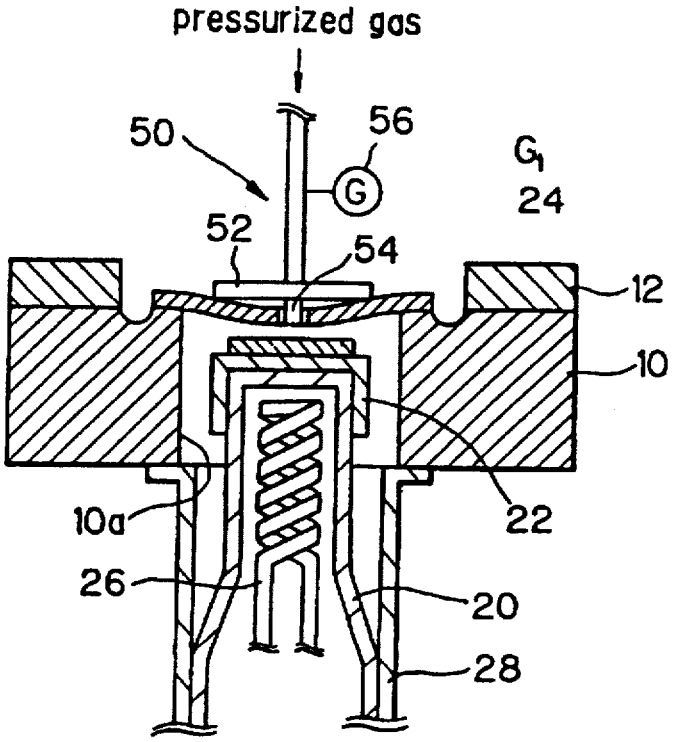
Figure 5:
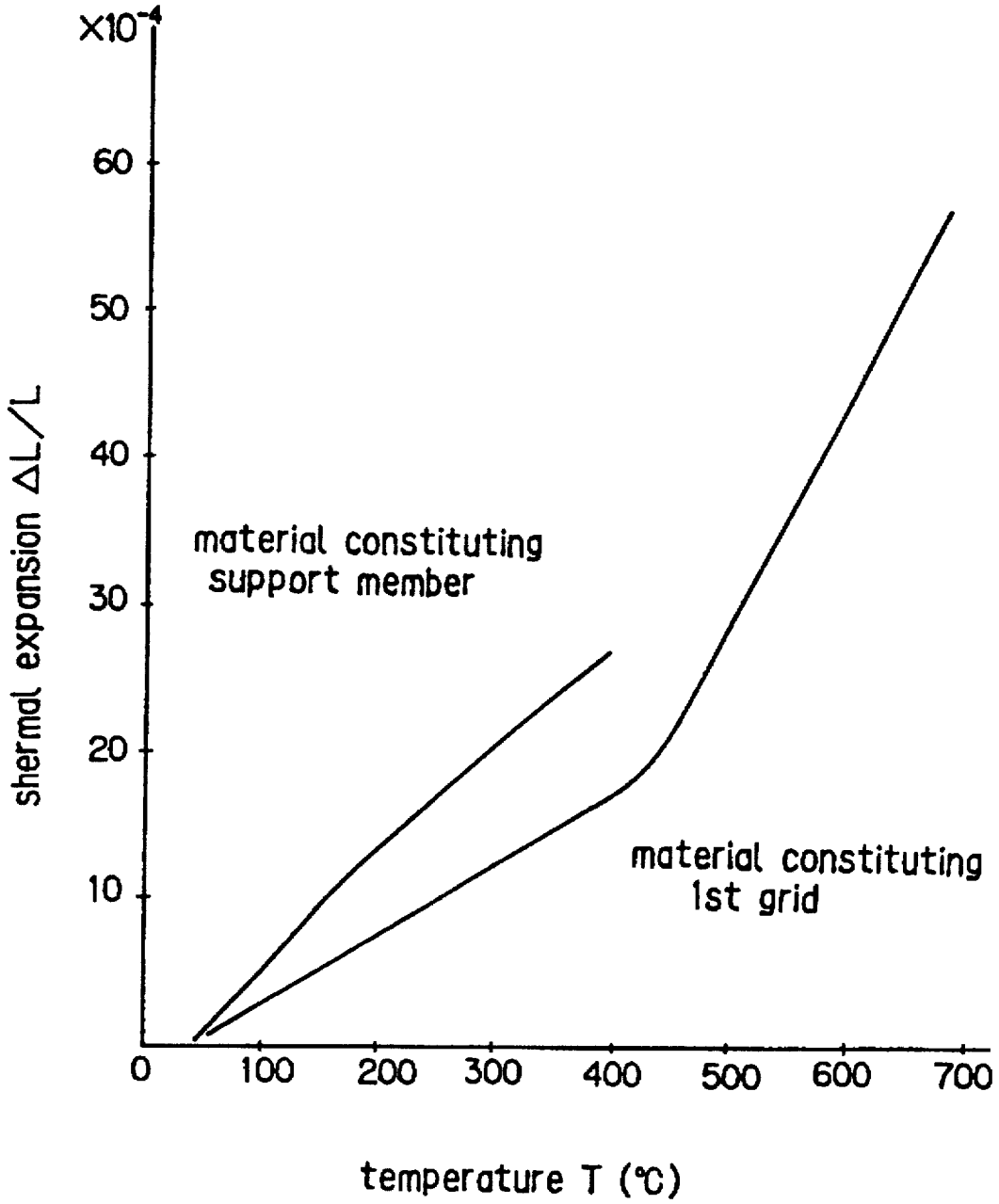
FIG. 5 is a graph showing thermal expansions of materials constituting a support member and a first grid in the invention.

An electron gun cathode structure of the type as shown in FIG. 1 includes a first grid $G_1$, a support member 10 made of an insulting material to which the first grid $G_1$ is fixed, and a cathode disposed on the side of the support member 10 opposite to the first grid $G_1$. A thermal expansion $\Delta L_S/L_S$ of a material constituting the support member 10 due to the heat from the cathode is larger than a thermal expansion $\Delta L_G/L_G$ of a material constituting the first grid $G_1$. More specifically, the support member 10 is made of alumina-based ceramics, and the first grid $G_1$ is made of a cover material. FIG. 5 shows relationships between temperature T and the thermal expansions $\Delta L/L$ of these materials.

A spacer 12 is also attached to the surface of the support member to which the first grid $G_1$ is fixed. A second grid $G_2$ is fixed to the top surface of the spacer 12. The spacer 12 defines the distance $d_{12}$ between the first grid $G_1$ and the second grid $G_1$. The cathode consists of a generally cylindrical sleeve 20, a cap covering a tip portion of the sleeve 20, and an oxide material 24 as an emission source provided on top of the cap 22.

When a CRT is operated, that is, a heater 26 of the cathode structure is turned on, the temperature of the first grid $G_1$ reaches 250° to 300° C. at its maximum, and that of the support member 10 reaches 150° to 200° C. at its maximum. As is understood from FIG. 5, in these temperature ranges, the thermal expansion $\Delta L_S/L_S$ of the support member 10 is larger than the thermal expansion $\Delta_L/L_G$ of the first grid $G_1$. Therefore, during the thermal expansion, the first grid $G_1$ is pulled by the support member 10 and can be prevented from being deformed.

It takes about 30 minutes from the turning on of the heater 26 to a time point when the thermal expansion of the sleeve 20 is stopped and the cathode temperature substantially comes into the steady state. No variation of the cathode cutoff voltage $E_{KCO}$ was found in its measurement conducted after the above period. Further, deformation of the first grid $G_1$ from the turning on of the heater 26 to a time point of 3 minutes passage therefrom was evaluated by an X-ray analysis, and almost no deformation was found. Also, no deviation was found between the apertures of the first grid $G_1$ and the second grid $G_2$.

The above advantageous effects are obtained by setting the thermal expansions of the support member 10 and the first grid $G_1$ so that they satisfy the following relationship:

$$0<L_S/L_S-\Delta L_G/L_G\leq 5\times 10^{-4}.$$

Figure 7:
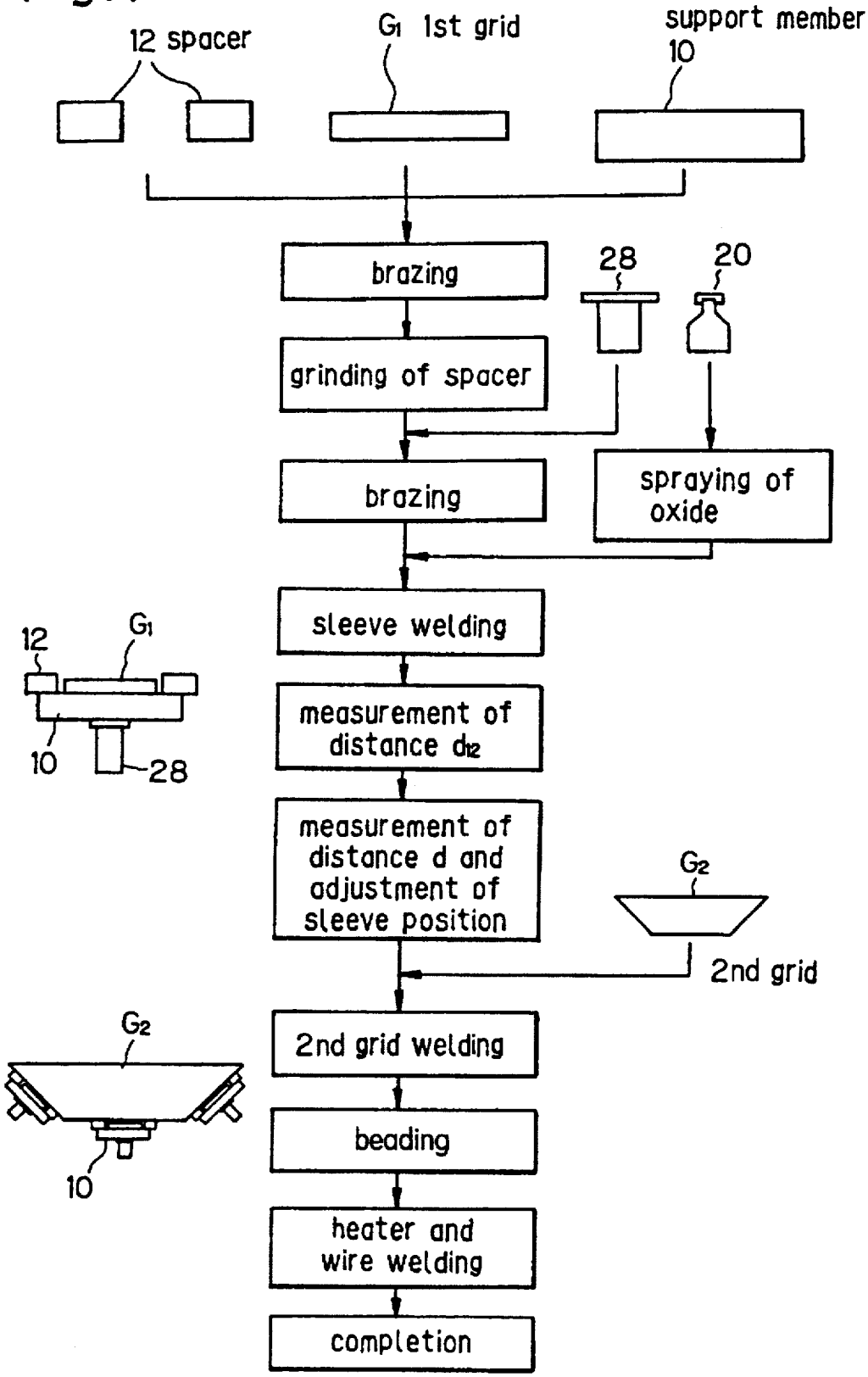
FIG. 7 is flowchart showing the entire manufacturing process of the electron gun cathode structure according to the invention.

The above electron gun cathode structure is assembled and manufactured by a method described below with reference to FIG. 7.

Figure 6A:
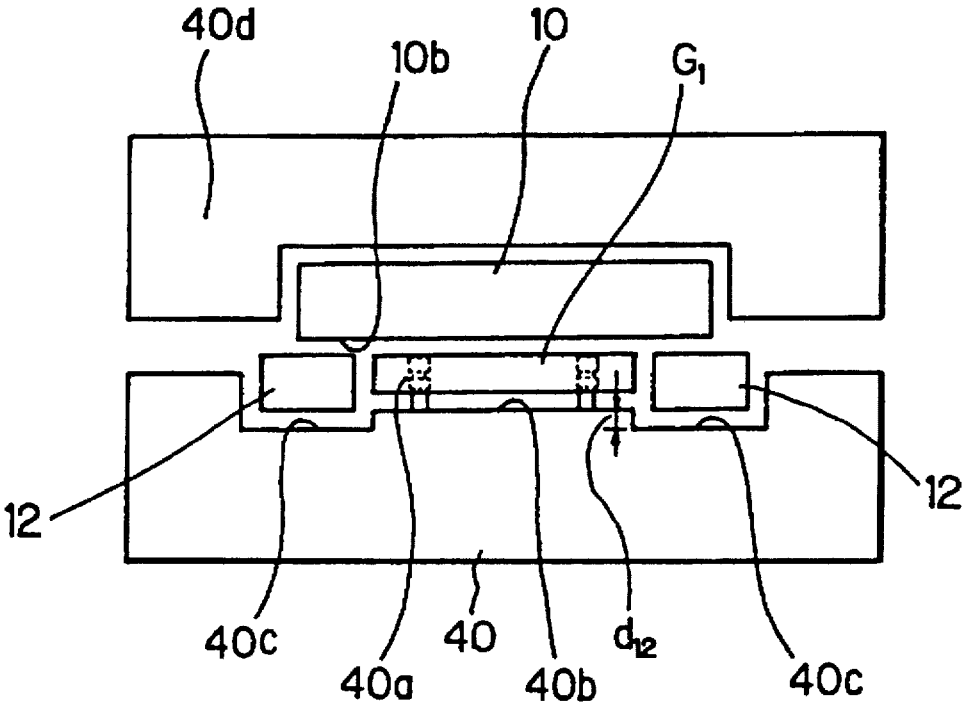
FIGS. 6A and 6B are side views showing a manufacturing method of an electron gun cathode structure according to the invention.

As shown in FIG. 6A, a member 40 having a first face **40*b* and a second face 40*c* is prepared in advance. The member 40 is a brazing jig. Shafts 40*a* are attached to the first face 40*b* of the member 40. The second face 40*c* is located outside the first face 40*b*, and is lower than the latter. The height of step between the first face 40*b* and the second face 40*c*** is equal to the distance $d_{12}$ between the first grid $G_1$ and the second grid $G_2$.

First, the first grid $G_1$ and the spacer 12 are attached to one surface of the support member 10 that is made of an insulating material, and then the cathode is placed so as to face the other surface of the support member 10.

More specifically, the first grid $G_1$ is placed on the first face **40*b* of the member 40 with the shafts 40*a* inserted into the first grid $G_1$. The metal spacer 12 made of, for instance, an iron-nickel alloy or a iron-cobalt-nickel alloy is placed on the second face 40*c* of the member 40. Then, the support member 10 is placed on the first grid $G_1$ and the spacer 12 so that a surface 10*b* of the spacer 10 is brought in contact with the first grid $G_1$ and the spacer 12. The surface 10*b* has been metalized in advance. An emission aperture $G_e$ (not shown in FIG. 6A) is formed in the first grid $G_1$ at its center. A through-hole 10*a* (not shown in FIG. 6A) is formed in the support member 10** so as to correspond to the emission aperture $G_e$.

Then, the first grid $G_1$ and the spacer 12 are fixed to the surface **10*b* of the support member 10 by brazing while the support member 10 is pressed toward the member 40 by using a pressing member 40*d*. Thus, the opposing faces of the first grid $G_1$ and the support member 10 and those of the spacer 12 and the support member 10** are brazed to each other.

When the first grid $G_1$ and the spacer 12 are fixed to the surface **10*a* of the support member 10, the fixing portions of the support member 10 and the first grid $G_1$ and those of the support member 10 and the spacer 12 serve as buffers. Therefore, even where there exist variations in the flatness of the support member 10, first grid $G_1$ and spacer 12, and variations of the thicknesses of a metal layer of the metalizing treatment, the spacer 12, the first grid $G_1$, etc., the distance $d_{12}$ can be set correctly by the step of the member 40. As a result, even a support member as sintered whose surface 10***a* etc. have not been ground can be used as the support member 10. In addition, the degree of management of the thicknesses of the brazing material, the metal layer of the metalizing treatment, etc. can be relaxed.

Figure 6B:
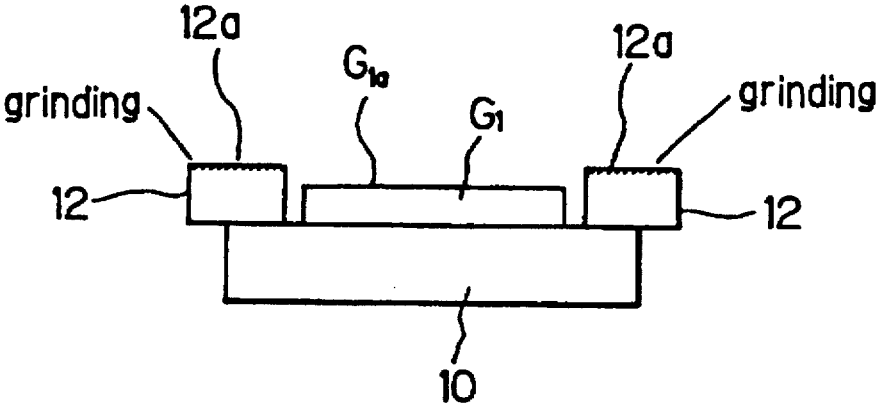

The electron gun cathode structure thus obtained is removed from the member 40. Then, as shown in FIG. 6B, a surface 12*a* of the spacer 12 opposite to the surface that is fixed to the support member 10 is ground so that the distance $d_{12}$ between the first grid $G_1$ and the second grid $G_1$ becomes a desired value. More specifically, the surface 12*a* of the metal spacer 12 is ground by an ordinary method using alumina or a diamond powder so that the distance between the surface 12*a* and a surface $G_1$ a of the first grid $G_1$ as measured using the surface $G_1$a of the first grid $G_1$ as a reference becomes the desired value.

While a variation (σ) of the distance $d_{12}$ was 3–5 μm before the grinding, it was less than 1 μm after the grinding, showing a marked improvement in the accuracy of the distance $d_{12}$.

Then, the distance $d_{12}$ between the top surface 12*a* of the spacer 12 and the top surface of the first grid $G_1$ is measured using a proper measuring instrument such as an optical length measuring device.

Figure 8:
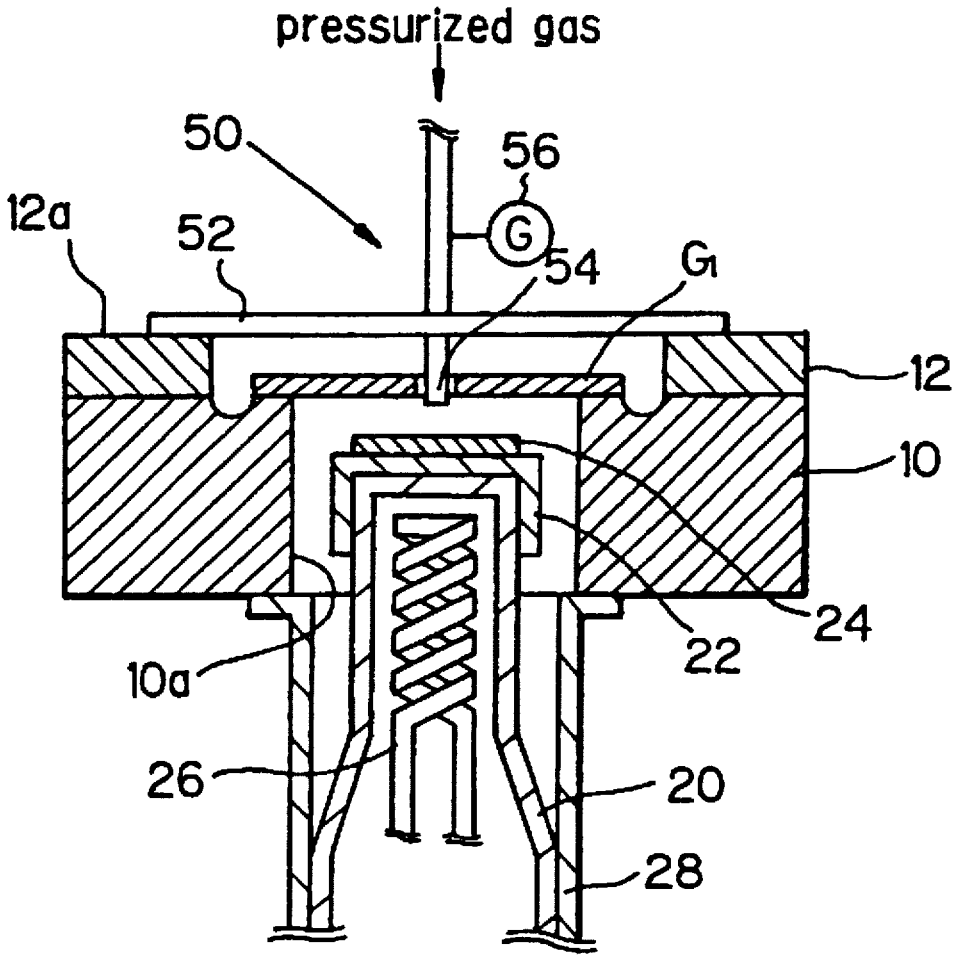
FIG. 8 shows a method of measuring the distance $d_{01}$ in the manufacturing method of the electron gun cathode structure according to the invention.

Then, a distance d between the top surface 12*a* of the spacer 12 and the cathode is measured using a non-contact type distance measuring instrument such as an air-micro device 50. More specifically, as schematically shown in FIG. 8, a reference surface 52 of the air-micro device 50 is brought in contact with the top surface 12*a* of the spacer 12, and a nozzle portion 54 of the air-micro device 50 is inserted into the emission aperture $G_e$ of the first grid $G_1$.

A pressurized gas such as a nitrogen gas or an air is jetted from the nozzle portion 54 of the air-micro device 50 to the oxide material 24 of the cathode. Since there exists a certain relationship between the back pressure of the pressurized gas and the distance between the nozzle portion 54 and the oxide material 24, the distance between the nozzle portion 54 and the cathode (specifically, the oxide material 24), i.e., the distance between the reference surface 52 and the cathode, in other words, the distance d between the top surface 12*a* of the spacer 12 and the cathode can be measured accurately.

A difference $d-d_{12}$ is calculated from the distance d thus measured and the distance $d_{12}$ that was previously measured. The position of the cathode with respect to the first grid $G_1$ is adjusted by moving the sleeve 20 with respect to the sleeve support member 28 so that the difference $d-d_{12}$ becomes a desired value. In this state, the sleeve 20 is fixed to the sleeve support member 28 by laser welding or resistance welding. In the above manner, the distance $d_{01}$ between the cathode and the first grid $G_1$ can be adjusted accurately by the method of assembling the electron gun cathode structure according to the invention.

Then, a second grid welding step is performed in which the spacer 12 etc. and the second grid $G_2$ are fixed to each other by laser welding or resistance welding. Then, the structure thus obtained and a third grid etc. (not shown) are subjected to beading. Finally, the heater 26 is mounted inside the sleeve 20 by laser welding or resistance welding and wire welding is subsequently performed, to complete an electron gun. A flowchart of the entire steps of manufacturing the electron gun cathode structure is shown in FIG. 7.

What is claimed is:

1. A method of manufacturing an electron gun of a cathode ray tube in which electron gun a first grid and a spacer for defining a distance between the first grid and a second grid are fixed to the same surface of a support member made of an insulating material, said method comprising the steps of:

setting a member including a first face and a second face having a step therebetween, a height of the step being equal to said distance;

placing the first grid on the first face;

placing the spacer on the second face;

placing the support member on the first grid and the spacer so that a surface of the support member is brought in contact with the first grid and the spacer, a thermal expansion of the insulating material constituting the support member due to heat from a cathode being larger than a thermal expansion of a material constituting the first grid due to heat from the cathode;

fixing the first grid and the spacer to the surface of the support member while pressing the support member toward the member;

grinding a top surface of the spacer opposite to a surface that is fixed to the support member so that a distance between the first grid and the second grid becomes a desired value; and fixing the second grid to the spacer.

2. The method according to claim 1, further comprising the steps of:

disposing the cathode on the other side of the support member;

measuring a distance $d_{12}$ between the top surface of the spacer and a top surface of the first grid; and measuring, with a non-contact type distance measuring instrument, a distance d between the top surface of the spacer and the cathode in a state that a reference surface of the non-contact type distance measuring instrument is in contact with the top surface of the spacer, and setting a position of the cathode with respect to the first grid so that a difference $d-d_{12}$ becomes a desired value.

3. The method according to claim 2, wherein the non-contact type distance measuring instrument is an air-micro device.

* * * * *